US005727748A

United States Patent [19]

Prittie

[11] Patent Number: 5,727,748

[45] Date of Patent: Mar. 17, 1998

[54] WEB INSPECTION AND REPAIR MACHINE WITH WEB INDEXER DEVICE

[75] Inventor: Allan R. Prittie, Islington, Canada

[73] Assignee: ARPECO Engineering Ltd., Ontartio, Canada

[21] Appl. No.: 707,722

[22] Filed: Sep. 4, 1996

[51] Int. Cl.[6] ..... B65H 20/34

[52] U.S. Cl. ..... 242/538.2; 226/118

[58] Field of Search ..... 242/538.2, 552; 226/118, 119

[56] References Cited

U.S. PATENT DOCUMENTS

| | | | |
|---|---|---|---|
| 2,936,506 | 5/1960 | Butler, Jr. et al. | 242/538.2 |
| 3,927,844 | 12/1975 | Bond et al. | 242/413.3 |
| 4,281,803 | 8/1981 | Massey | 242/552 |
| 4,777,513 | 10/1988 | Nelson | 226/118 |
| 4,886,199 | 12/1989 | Noe et al. | 226/118 |
| 5,111,336 | 5/1992 | Martino et al. | 242/538.2 |
| 5,163,594 | 11/1992 | Meyer | 242/411 |

FOREIGN PATENT DOCUMENTS

| | | | |
|---|---|---|---|
| 58-135725 | 8/1983 | Japan | 242/418 |

*Primary Examiner*—John P. Darling
*Attorney, Agent, or Firm*—Shoemaker and Mattare Ltd.

[57] ABSTRACT

A device for the inspection and repair of a roll of web material includes an unwind mandrel, a rewind mandrel, an inspection area and a splice area. A flaw in the web is detected at the inspection area, whereupon the web is braked to a halt. Where the splice area is adjacent to or coincident with the inspection area, the flawed portion of the web can pass well beyond the splice area before the web comes to a halt. Provided herein is a web-indexer device that includes a reciprocating indexer shuttle having idler rolls mounted thereon, with further idler rolls mounted to the machine such that the web material can be between them in a substantially boustrophedonic configuration. Control is provided to allow the operator who has caused the web to be braked to a halt upon detecting a flaw, to move the indexer frame so as to retrieve a portion of the web so as to bring the flaw back to the splicing station for repair, without having to reverse the rotational direction of the unwind mandrel or the rewind mandrel.

6 Claims, 3 Drawing Sheets

WEB INSPECTION AND REPAIR MACHINE WITH WEB INDEXER DEVICE

This invention relates generally to web inspection and converting machines which are adapted to perform various process steps on an elongate web. The machine typically has an unwind mandrel and a rewind mandrel, and the web is provided initially in the form of a coil or roll of web material which can be fitted on the unwind mandrel. The web is then strung through various possible combinations of devices such as idler rolls, error detectors, splicers, die cutters, print heads, and web slitters. Slitting the web may be required when the web carries a sequence of images, with two or more images located across the web. Inspection of the moving web can be done electronically, or visually with the assistance of a stroboscope, vision or video system that samples the moving web.

BACKGROUND OF THIS INVENTION

In conventional web inspection machines, regardless of the means of error detection, the fundamental requirement is to locate the position of an error along the length of the web, and subsequently to decelerate and stop the machine in such a manner that the error is positioned at a "splice station" where it may be corrected by the operator. Several methods are conventionally used to achieve this requirement.

(a) A first method, for use with uni-directional machines that cannot be reversed, involves providing a sufficient distance (along the web path) between the inspection point and the splice station to enable the section of the web with the detected error to be stopped at, or prior to, the splice station. If the error passes by the splice station, it cannot be "brought back" to the splicing area because the machine is not capable of reversing the movement of the web. Providing the required length of web between the inspection and spliced areas represents a compromise, since more physical room is required, and a greater length of web must be redirected and guided.

(b) When a reversing machine is utilized, the web can be wound back onto the unwind mandrel of the machine. However, this option is often compromised by another function of the machine, namely the slitting of the web just prior to passing into the machine rewind. Once a web is slit, it normally cannot be reversed through the slitter section. For this reason, bi-directional machines are generally used where slitting is not required. Alternatively, the slitting is done on a second (post inspection) pass. Also, a reversing machine can often encounter difficulties with web guiding.

GENERAL DESCRIPTION OF THIS INVENTION

The present development relates to a third way for error positioning, which effectively addresses the shortcomings of the web handling techniques mentioned in the previous section without moving the unwind or rewind rolls. The proposed improvement and method essentially involve a web indexing device which is equipped with an integral variable position translating mechanism.

Accordingly, this invention provides, in a machine allowing inspection and repair of a roll of web material, the machine including:

a) an unwind mandrel, b) a rewind mandrel, c) an inspection area, d) a splice area, e) guide rolls for directing the web along a path from the unwind mandrel, past the inspection and splice areas in any sequence, to the rewind mandrel, and f) first console means for causing the web to move past said inspection and splice areas, and to allow an operator to brake the web to a standstill upon the detection of a flaw in the web;

the improvement which comprises:

providing said machine with a web indexing device including:

g) an indexer shuttle mounted for back and forth movement with respect to the machine, h) a first plurality of idler rolls mounted to said indexer shuttle, i) a second plurality of idler rolls mounted to said machine, and so positioned with respect to the first plurality of idler rolls that web material can be strung therearound in substantially boustrophedonic configuration, and j) second control means adapted, upon detection of a flaw at the inspection station, and upon braking of the web to a standstill, to move the indexer shuttle so as to return an identified portion of the web to the splicing station for repair, verification or any type of modification, without having to reverse the rotational direction of the unwind mandrel or the rewind mandrel.

Further, this invention provides a method of inspecting and repairing a roll of web material, for use with a machine which incorporates: an unwind mandrel; a rewind mandrel; an inspection area; a splice area; guide rolls for directing the web material along a path from the unwind mandrel, past the inspection and splice areas in any sequence, to a rewind mandrel; control means to cause the web material to move past said inspection and splice areas, and to allow the web to be braked to a standstill upon the detection of a feature being searched for along the web; an indexer shuttle mounted for back and forth movement with respect to the machine; a first plurality of idler rolls mounted to said indexer shuttle; and a second plurality of idler rolls mounted to said machine, the method including the steps of:

a) stringing the web material around the first and second pluralities of idler rolls in substantially boustrophedonic configuration;

b) unwinding the roll of web material at the unwind mandrel, while rewinding the web material at the rewind mandrel, whereby the web material moves past the inspection and splice areas;

c) inspecting the web material at the inspection area in order to detect a feature being searched for;

d) when such feature is detected, using the control means to brake the web material to a standstill;

e) moving the indexer shuttle in the direction which will reposition the feature-containing portion of the web material at the splicing station without reversing the rotation of either mandrel; and f) repairing the web material.

GENERAL DESCRIPTION OF THE DRAWINGS

Several embodiments of this invention are illustrated in the accompanying drawings, in which like numerals denote like parts throughout the several views, and in which.

DETAILED DESCRIPTION OF THE DRAWINGS

Figure 6:
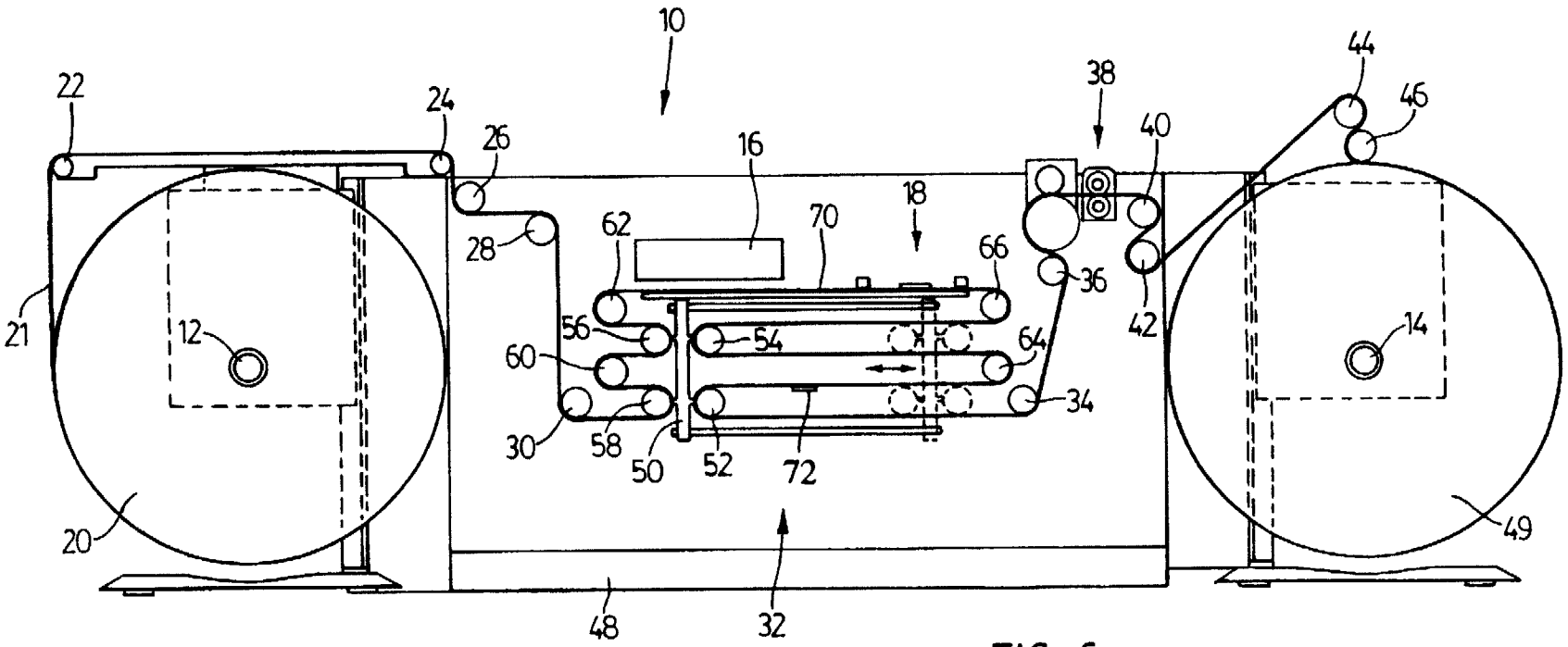
FIG. 6 is a schematic elevational view of a machine similar to that shown in FIG. 5, with a further variant of the improvement provided by the present invention.

Attention is first directed to FIG. 6, which is a schematic elevational view showing the major components of a web processing mechanism to which the present invention has been applied.

The mechanism shown generally at 10 in FIG. 6 is seen to include an unwind mandrel 12, a rewind mandrel 14, an inspection area 16, and a splice area 18.

A coil 20 of web material is mounted on the unwind mandrel 12, with the web being paid off the coil 20, and looping around stationary idler rolls 22, 24, 26, 28 and 30. The web then passes through a web indexing mechanism shown generally at the arrow 32, the details of which will be described below. The web 21 exiting from the web indexing device is entrained around fixed idler rolls 34 and 36, from which it enters a slitting mechanism 38, emerging to loop around idler rolls 40 and 42, thence passing around idler rolls 44 and 46. The latter two rolls 44 and 46 are mounted at one end of a lever arm which is pivoted at the other end to a portion of the frame 48 (lever arm not illustrated). This arrangement allows the rolls 44 and 46 to follow the gradually increasing diameter of the rewind coil 49, with downward pressure exerted by the rolls 46 ensuring that the web will be wound up with adequate tightness.

Turning now the web-indexing device 32, it should be noted firstly that this device is located directly under the stationary inspection area 16 and the stationary splice area 18. The device 32 includes an indexer shuttle 50 which is vertically elongate and which supports four idler rolls 52, 54, 56 and 58.

To complete the indexing arrangement there are provided four additional idler rolls 60, 62, 64 and 66, which are fixed with respect to the frame 48. The indexer shuttle 50 is shown in solid lines in its furthest leftward position, which corresponds to the normal operation of the web handling machine, but it can move to a rightward position shown in broken lines in FIG. 6, or any intermediate position, in order to return an identified portion to the splice area 18 for repair, review or modification.

It will be noted that idler rolls 62 and 66 are generally level with a horizontal table 70 constituting the inspection area and the splice area.

Beginning with the left-hand side, it will be noted that the web is looped around the various fixed and movable idler rolls in the following sequence: 30, 58, 60, 56, 62, 66, 54, 64, 52 and 34. The rolls 58, 60, 56 and 62 are positioned such that the web path between them is boustrophedonic, and the same is true for the idler rolls 52, 64, 54 and 66.

In the use of the machine shown in FIG. 6, the operator stands or sits at the inspection area and uses conventional control means for causing the web in the coil 20 to move along the path illustrated in FIG. 6, which includes moving the web past the inspection area 16 and the splice area 18. The inspection area includes suitable means to enable the operator to detect flaws in the web (for example a missing label in the case of a web acting as a substrate for a plurality of labels). When the operator detects a flaw, he uses conventional braking means (not illustrated in FIG. 6) to brake the web to a standstill. He then uses a second control means to move the indexer shuttle 50 to the right (as pictured in FIG. 6) sufficiently far to bring the web flaw back to the splice area 18. This is accomplished without having to rotate either the unwind mandrel or the rewind mandrel.

In FIG. 6, the flat rectangle 72 represents a flaw in the web, and its position approximately represents the furthest that the flaw can enter the indexing arrangement, and still be brought back to the splice area 18 by movement of the indexer shuttle to the furthest rightward position (shown in broken lines in FIG. 6). Mathematically, the distance along the web between the position shown by the numeral 72 and the center of the splice area is approximately four times the maximum left-to-right displacement of the indexer shuttle 50, due to the fact that there are four web reaches in the boustrophedonic configuration.

When the flaw has moved back to the splice area through the rightward motion of the indexer shuttle, the operator can then attend to the splicing task. When the splicing has been completed, the indexer shuttle 50 can be moved back to its running position, and the web-handling machine can be restarted.

Figure 5:
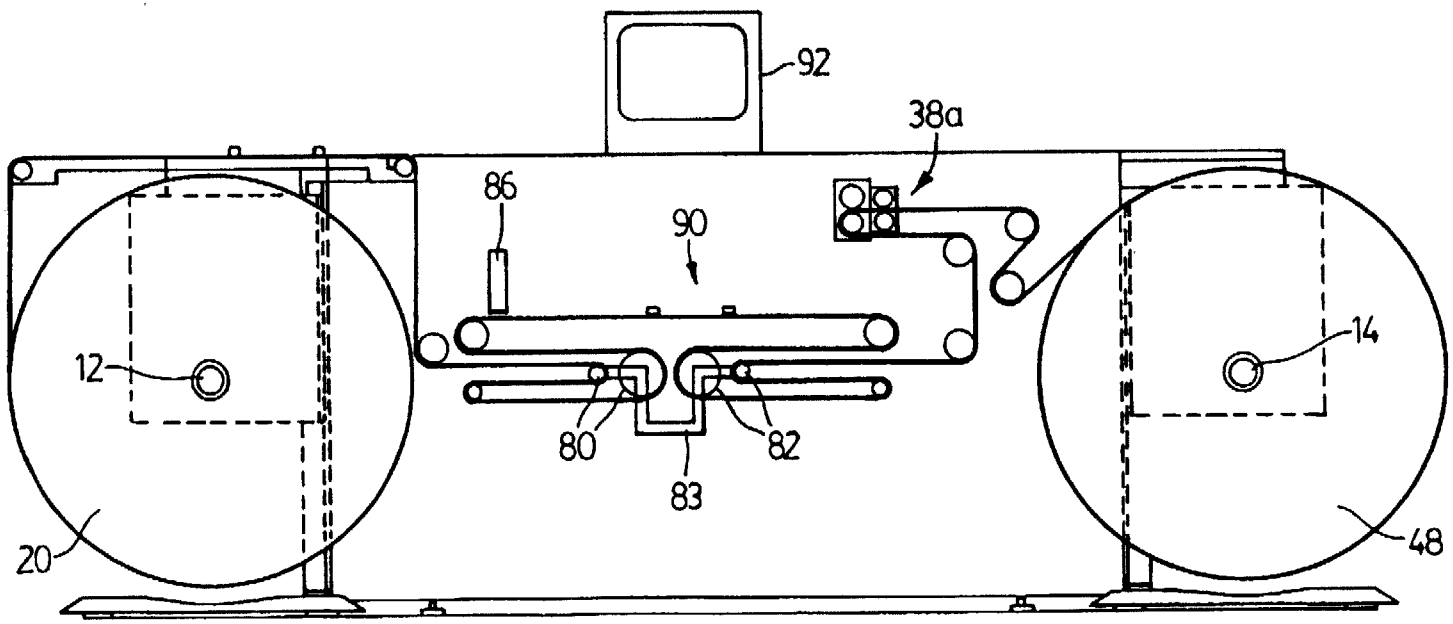
FIG. 5 is a schematic elevational view of a further embodiment of this invention.

FIG. 5 shows a web-handling machine somewhat similar to that illustrated in FIG. 6 and described above, except that the indexer device is differently configured. Specifically, two idler roll pairs, 80 and 82, are mounted on opposite sides of an indexer shuttle 83, which is mounted for movement in the left-to-right direction. The remaining rolls are stationary. In this arrangement, a video camera 86 is used to detect flaws in the web, the video camera 86 being mounted to the left of a splicing station 90. The signal from the video camera 86 passes to a video monitor 92, which is watched by the operator. A slitting mechanism **38*a* is provided, having the same function as the slitting mechanism 38 in FIG. 6**.

Figure 1:
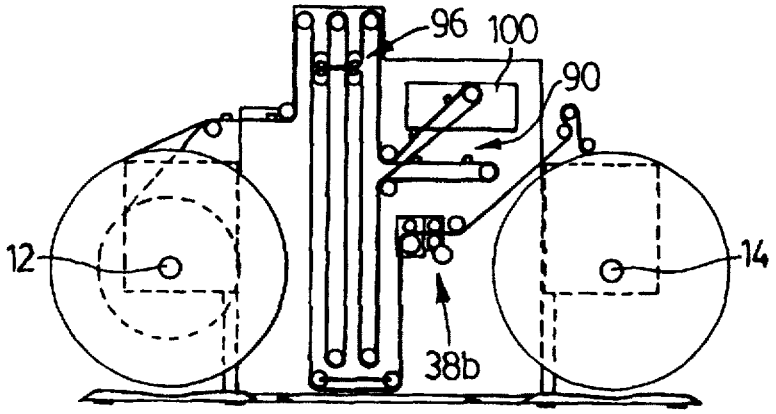
FIG. 1 is a schematic side elevational view of a first embodiment of this invention.

FIG. 1 illustrates a configuration in which the indexer shuffle (not illustrated) is vertically movable. FIG. 1 does illustrate the movable idler rolls 96 which form part of the indexer shuttle. The machine in FIG. 1 incorporates a vertically movable unwind mandrel 12, a vertically movable rewind mandrel 14, an inspection monitor device 100 and a splicing station 90. A slitting device **38*b* is also provided. The operation of the machine shown in FIG. 1 is essentially the same as that for the machine shown in FIG. 6**.

Figure 2:
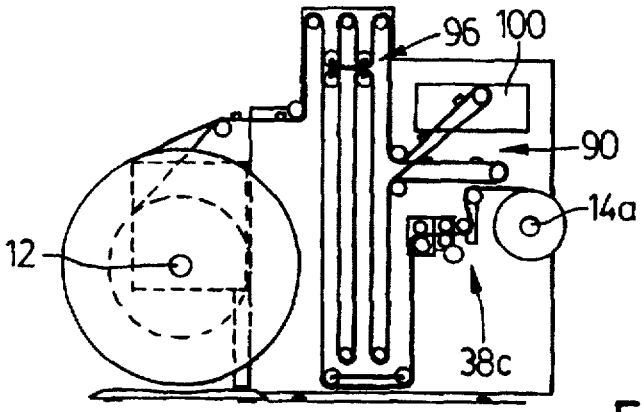
FIG. 2 is a schematic elevational view of a second embodiment of this invention.

FIG. 2 shows a machine very similar to that in FIG. 1, with the exception that the rewind mandrel **14*a*** is mounted in a fixed position, and is adapted to receive only relatively small coils of web.

Figure 3:
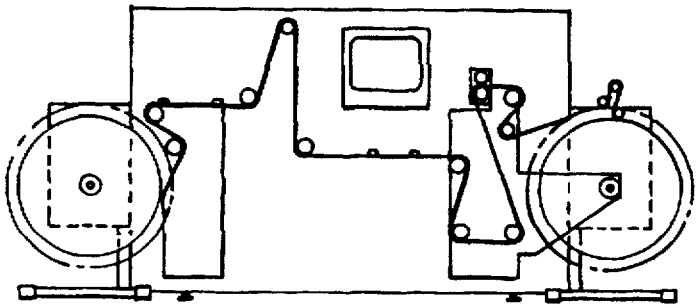
FIG. 3 (PRIOR ART)
FIG. 3 is a schematic elevational view of a web-reversing apparatus without the improvement of this invention, representing the prior art.

FIG. 3 shows a prior art machine capable of reversing web movement, and therefore not requiring an indexer for the purpose of bringing a flawed portion of the web back to a splicing station.

Figure 4:
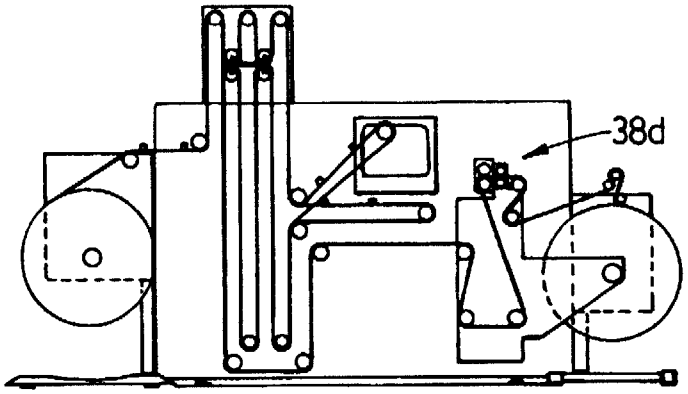
FIG. 4 is a schematic elevational view of a machine capable of reversing, to which the improvement of this invention has been applied.

FIG. 4 shows a machine similar to that illustrated in FIG. 3, with the addition of an indexer shuttle and the positioning of the idler rolls so as to allow the web to be strung boustrophedonically. The FIG. 4 machine has the addition of a slitter **38*d***.

The remaining components of the machines shown in FIGS. 1, 2 and 4 have functions which are obvious from the drawings, in the light of the specific description of the machine shown in FIG. 6.

Though not illustrated, it is proposed that the indexer shuttle be mounted on rails or the like, and positioned either by a cylinder, a ball screw, or similar actuator device.

It will be understood from the above that the web-accumulation device described herein is applicable to various kinds of machines, such as inspectors, die cutters, printing presses and other types of web converting machines.

While several embodiments of this invention have been illustrated in the accompanying drawings and described hereinabove, it will be evident to those skilled in the art that changes and modifications may be made therein, without departing from the essence of this invention, as set forth in the appended claims.

What is claimed is:

1. In a machine allowing inspection and repair of a roll of web material, the machine including:

a) an unwind mandrel, b) a rewind mandrel, c) an inspection area, d) a splice area, e) guide rolls for directing the web along a path from the unwind mandrel, past the inspection and splice areas in any sequence, to the rewind mandrel, and f) first control means for causing the web to move past said inspection and splice areas, and to allow an operator to brake the web to a standstill upon the detection of a flaw in the web;

the improvement which comprises:

providing said machine with a web indexer device including:

g) an indexer shuttle mounted for back and forth movement with respect to the machine, h) a first plurality of idler rolls mounted to said indexer shuttle, i) a second plurality of idler rolls mounted to said machine, and so positioned with respect to the first plurality of idler rolls that web material can be strung therearound in substantially boustrophedonic configuration, and j) second control means adapted, upon detection of a flaw at the inspection station, and upon braking of the web to a standstill, to move the indexer shuttle so as to return an identified portion of the web to the splicing station for repair, verification or any type of modification, without having to reverse the rotational direction of the unwind mandrel or the rewind mandrel.

2. The improvement claimed in claim 1, in which said first plurality of idler rolls includes a first sub-plurality and a second sub-plurality, and in which said second plurality of idler rolls includes a third sub-plurality and a fourth sub-plurality, said sub-pluralities being disposed such that web material can be strung boustrophedonically between the first and third sub-pluralities on one side of the splice area, and can be strong boustrophedonically between the first and third sub-pluralities on the other side of the splice area.

3. The improvement claimed in claim 2, in which each said sub-plurality includes at least two idler rolls.

4. A method of inspecting and repairing a roll of web material, for use with a machine which incorporates: an unwind mandrel; a rewind mandrel; an inspection area; a splice area; guide rolls for directing the web material along a path from the unwind mandrel, past the inspection and splice areas in any sequence, to a rewind mandrel; control means to cause the web material to move past said inspection and splice areas, and to allow the web to be braked to a standstill upon the detection of a feature being searched for along the web; an indexer shuttle mounted for back and forth movement with respect to the machine; a first plurality of idler rolls mounted to said indexer shuttle; and a second plurality of idler rolls mounted to said machine, the method including the steps of:

a) stringing the web material around the first and second pluralities of idler rolls in substantially boustrophedonic configuration;

b) unwinding the roll of web material at the unwind mandrel, while rewinding the web material at the rewind mandrel, whereby the web material moves past the inspection and splice areas;

c) inspecting the web material at the inspection area in order to detect a feature being searched for;

d) when such a feature is detected, using the control means to brake the web material to a standstill;

e) moving the indexer shuttle in the direction which will reposition the feature containing portion of the web material at the splicing station without reversing the rotation of either mandrel; and f) repairing the web material.

5. The method claimed in claim 4, in which said first plurality of idler rolls includes a first sub-plurality and a second sub-plurality and said second plurality of idler rolls includes a third sub-plurality and a fourth sub-plurality, the web material being strung boustrophedonically between the first and third sub-pluralities on one side of the indexer shuttle, and being strung boustrophedonically between the first and third sub-pluralities on the other side of the indexer shuttle.

6. The method claimed in claim 5, in which each said sub-plurality includes at least two idler rolls.

* * * * *